US005392896A

United States Patent [19]

Martelli

[11] Patent Number: 5,392,896

[45] Date of Patent: Feb. 28, 1995

[54] METHOD FOR AUTOMATICALLY ADJUSTING A DRAWER CONVEYOR IN ACCORDANCE WITH THE SIZE OF ARTICLES TO BE TRANSPORTED, AND CONVEYOR THAT CARRIES OUT THE METHOD

[75] Inventor: Guglielmo Martelli, Loddington Northants, United Kingdom

[73] Assignee: A.M.R.P. Handels AG, Basel, Switzerland

[21] Appl. No.: 198,483

[22] Filed: Feb. 18, 1994

[30] Foreign Application Priority Data

Feb. 22, 1993 [IT] Italy ..... B093A000058

[51] Int. Cl.[6] ..... B65G 29/00

[52] U.S. Cl. ..... 198/473.1; 198/803.11

[58] Field of Search ..... 198/473.1, 803.11

[56] References Cited

U.S. PATENT DOCUMENTS 3,809,210 5/1974 Anderson ..... 198/803.11 X
5,188,217 2/1993 Bruno ..... 198/473.1 X
5,282,530 2/1994 Neri ..... 198/803.11 X

FOREIGN PATENT DOCUMENTS 3815557 12/1988 Germany .
2256627 12/1992 United Kingdom .

*Primary Examiner*—Cheryl L. Gastineau
*Attorney, Agent, or Firm*—McAulay Fisher Nissen Goldberg & Kiel

[57] ABSTRACT

A method allows to automatically adjust a drawer conveyor in accordance with the size of articles to be transported, the conveyor running along a closed loop path and including transporting drawers comprising a pair of walls which define the dimension of the drawers. The method includes releasing one of the walls in a first section of the conveyor path, moving the released wall in a second section of the conveyor path, until it is positioned at a pre-set distance from the other one, and locking again the previously released wall in a third section of the conveyor path. The conveyor includes an operating station designed to carry out subsequently on each drawer the operations described above.

11 Claims, 7 Drawing Sheets

FIG. 8b
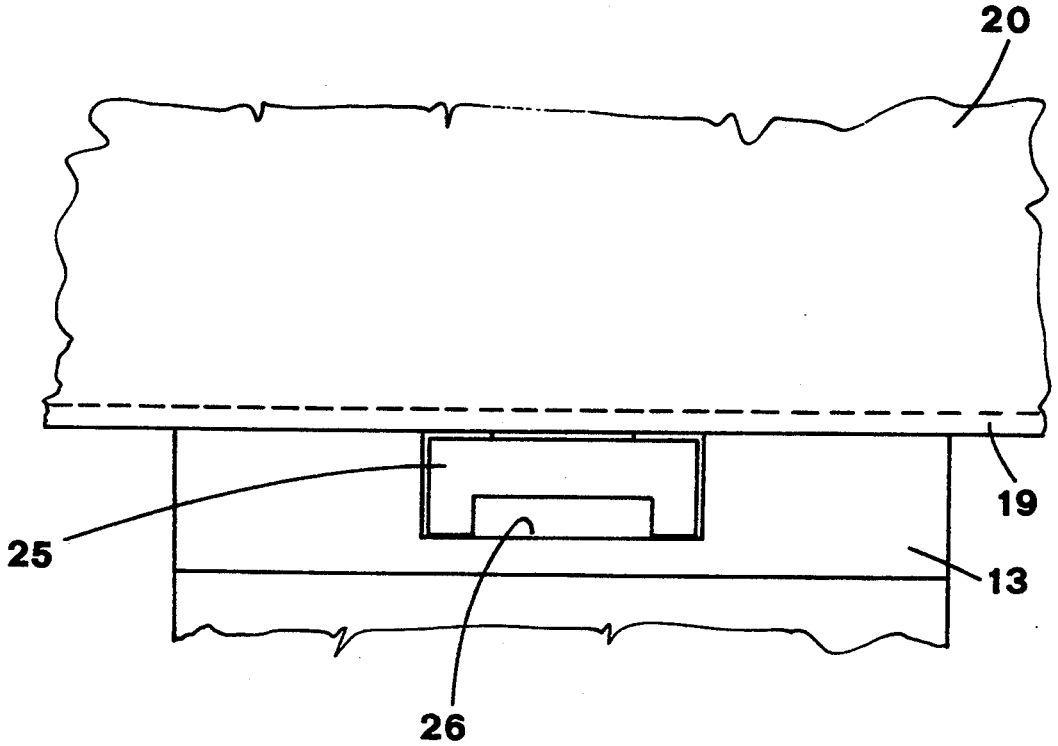
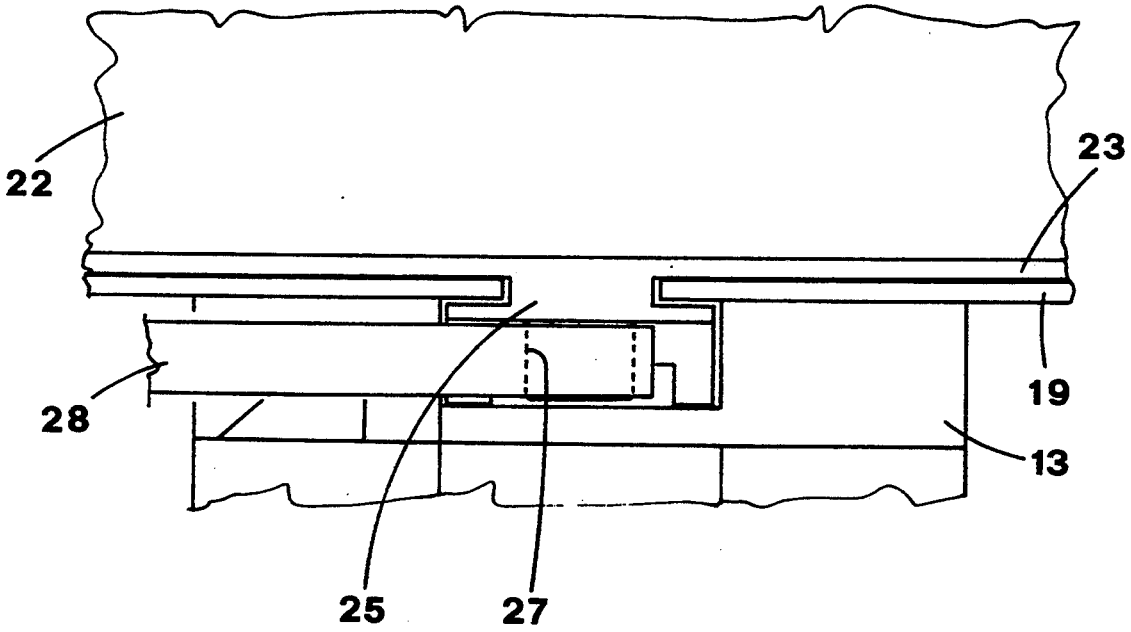
FIG. 8a

METHOD FOR AUTOMATICALLY ADJUSTING A DRAWER CONVEYOR IN ACCORDANCE WITH THE SIZE OF ARTICLES TO BE TRANSPORTED, AND CONVEYOR THAT CARRIES OUT THE METHOD

BACKGROUND OF THE INVENTION

The present invention concerns a method for automatically adjusting a drawer conveyor in accordance with the size of articles to be transported. The conveyor which the method refers to, runs along a closed loop path and is equipped with conveying drawers comprising a pair of walls which define the dimension of the drawers.

DESCRIPTION OF THE PRIOR ART

Currently, automatic packaging machines that insert products into cases, generally include three closed loop conveyors, placed side by side with their upper runs substantially coplanar.

The first conveyor is equipped with stopping means for positioning of erected preformed cases thereon, the erected cases having at least an open side facing the second conveyor.

This second conveyor is equipped with drawers for products which are lined up with the cases carried by the first conveyor while the third conveyor is equipped with pusher means operated transversely while they move along the upper run of the packaging line, so that the pushing means moves the products carried by the second conveyor towards the respective cases on the first conveyor, thus inserting them therein.

The drawers comprise lateral walls arranged transversely in respect to the transport direction, and are fed with product at the side opposite to the side facing the case carrying conveyor.

The basic problem of the drawer conveyors concerns the possibility of adjustment of the drawers in accordance with the size of the products to be conveyed, that means to change the dimension of the drawers accordingly.

For this purpose some conveyors have at least one of the side walls making up the drawers that is made movable with respect to the other that is fixed to the drawer support body, and the translation of said movable drawer is provided by different systems.

For example, notches may be made in the drawer support body and may be spaced apart in the transport direction, the notches being designed to receive in engagement the movable walls that can be set in the most suitable position. This system, however, requires considerable costs and work and the machine being stopped at every adjustment.

In accordance with a second system, that is described in the Italian Patent Application No.RM91A000091, the movable wall can be shifted to the suitable position, while the conveyor is in operation, by means acting along the advancement direction in a continuous way and coacting with translating means carried by the drawer body and linked to the movable wall.

According to a third system, a plurality of housings are defined by couples of prongs respectively located on the two longitudinal sides of the conveyor and made integral with two sets of chains, each one including include two or more chains. Each couple of prongs are set at a distance from the following couple equal to the product width.

All the chains are moved with the same speed, while one set of chain can be shifted in respect of the other in order to adjust the conveyor in accordance with the product size, so as to obtain the desired longitudinal distance between the pairs of prongs belonging to the respective sets of chains.

On one side, this arrangment allows to obtain the adjustment with a minimal number of steps, on the other side, however, it implies constructive complications and subsequent realization and maintainance costs.

Moreover, such a solution brings about functional problems, since it is the product that is transversally pushed toward the relative package thus making it possible for the product to strike the edge of the open side of the package.

In case of a drawer conveyor, each drawer translates transversally toward the relative package, partially inserts therein through open side, and consequently, the drawer's entering into the package facilitates subsequent product introduction into the package.

The document DE-A-3815557 discloses a drawer conveyor with one wall of each drawer carried by two chains and the other wall of the same drawer carried by two further chains placed bilaterally to the precedent ones.

During operation the four chains are driven with the same speed: in this way the same distance between the walls of various drawers is maintained.

In order to change the drawer dimension, the chains relative to one wall are shifted in respect to the others until the desired dimension is obtained for the drawers.

Such a solution provokes not only constructive and space complications, but also a disadvantage resulting from the fact that possible anomalies, e.g. caused by chains lengthenings, affect all the drawers.

SUMMARY OF THE INVENTION

Therefore, the object of the present invention is to avoid the above reported disadvantages by proposing a method for automatically adjust a drawer conveyor in accordance with the size of the article to be transported, the conveyor running along a closed loop path and being equipped with transporting drawers, each comprising a pair of walls.

The method is characterized by the fact that it includes the following steps:

- releasing one wall while the drawer is running a first section of the conveyor path;
- shifting the above mentioned wall while the drawer is running a second section of the same path, until the wall is set at a pre-determined distance from the other wall;
- locking again the wall previously released, when the drawer is in a third section of the conveyor path.

The said method is further characterized by the fact that an adjustment station works for a period of time necessary for all the drawers to pass through it, that is, in case of a single station, for a time necessary to complete a full turn of said closed loop.

Another object of the present invention is to provide a conveyor that can be automatically adjusted in accordance with the size of the product to be transported. This conveyors runs along a closed loop path and is equipped with convey drawers comprising a pair of walls.

Said conveyor is characterized by the fact that it comprises:

conveying means that have a first stationary wall and a second wall adapted to alternatively assume two different configurations: a first locking configuration, in wich it cannot be shifted with respect to said first wall, and a second released configuration in which it can be shifted with respect of said first stationary wall;

operating means designed to release said second wall while the related drawer runs a first section of the conveyor path, and to keep the same wall released while the drawer runs a second section of the closed loop path;

positioning means designed to locate said second wall at a desired distance from said first stationary wall while the related drawer runs said second section of the path.

A further object of the present invention is to provide said conveying means that comprise:

guide means for allowing said second wall to slide while moving closer to, or parting away from, said first stationary wall;

locking means for locking said second wall; and translation means aimed at imposing a translation to said second wall.

The guide means consist of a pair of prismatic couplings, placed centrally in the drawer and oriented in longitudinal direction, and of a sliding element that runs beneath the bottom of the drawer and inside a groove made in the convey block. The sliding element has one its end fixed to said second wall and in this way it defines a double "T" that slides between internal corners of a slit, transversal to said walls, made in the drawer bottom.

The locking means comprise:

a first rack element jointed to said second wall and slidingly guided by the convey means, a second lever element, normally oscillating in the gliding direction of said first element and pivoted to the transport means, that at one of its ends carries a toothed sector designed to engage with, or disengage from, said first element while at the other end it carries a cam follower roller for the oscillation operation designed to cooperate with said operating means, and a reset spring acting on said second oscillating lever element designed to return said second element to the position of engagement with said first rack element.

The translation means consist of an angular lever situated under the drawer bottom and pivoted to the same; one end of said lever is pivoted on said second wall and the other end carries a cam following roller designed to cooperate with said positioning means.

A further object of the present invention is to provide said operating means that comprise first shifting means placed longitudinally and mobile transversally in respect to the transport direction;

said shifting means comprise a plate mobile transversally to the conveyor direction with the side facing the conveying means profiled in form of a cam extending longitudinally to the conveying direction to cooperate with said conveying means, while in the proximity of the opposite side there is a cam following roller designed to operate in the track of a drum cam that is rotatably carried by the structure of the machine.

A still further, but not the last object of the present invention is to provide said positioning means that comprise:

shifting means situated longitudinally and mobile transversally to the conveying direction;

adjusting means to operate and determine the transversal position of said shifting means;

and link means to connect said shifting means with said adjusting means in an oscillating or standstill way;

The shifting means include a first shifting plate that has a funnel-like grooves longitudinal to the conveying direction and designed to cooperate with the translating means rollers of said second wall.

Said adjusting means consist of an adjustment handwheel turnably mounted on the machine structure that carries a keyed bar threaded normally to the conveying direction, said bar screws down into a second positioning plate.

The link means comprise an adjustable conical coupling comprising a conical member that is connected to the shifting means and another conical member connected to the adjusting means.

DESCRIPTION OF THE DRAWINGS

Further characteristics and advantages of the present invention will result from the following detailed description of its preferred embodiment, that is described as a mere example not limitative, with reference to the enclosed figures, in which:

FIGS. 8*a* and 8*b* are two constructive particulars of the guides of the drawer body in the views frontal and back to the conveying direction.

DESCRIPTION OF THE PREFERRED EMBODIMENT

Figure 1:
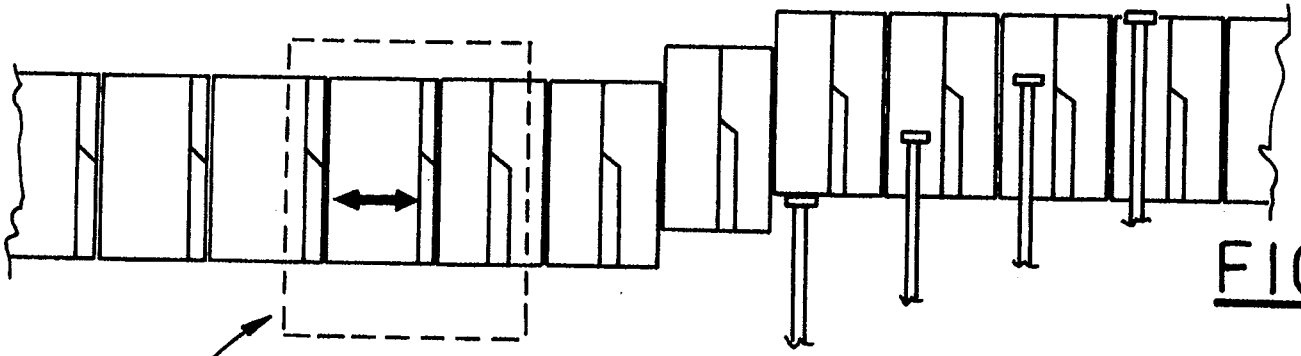
FIG. 1 is a plan view of the drawer conveyor during the adjustment phase.
Figure 2:
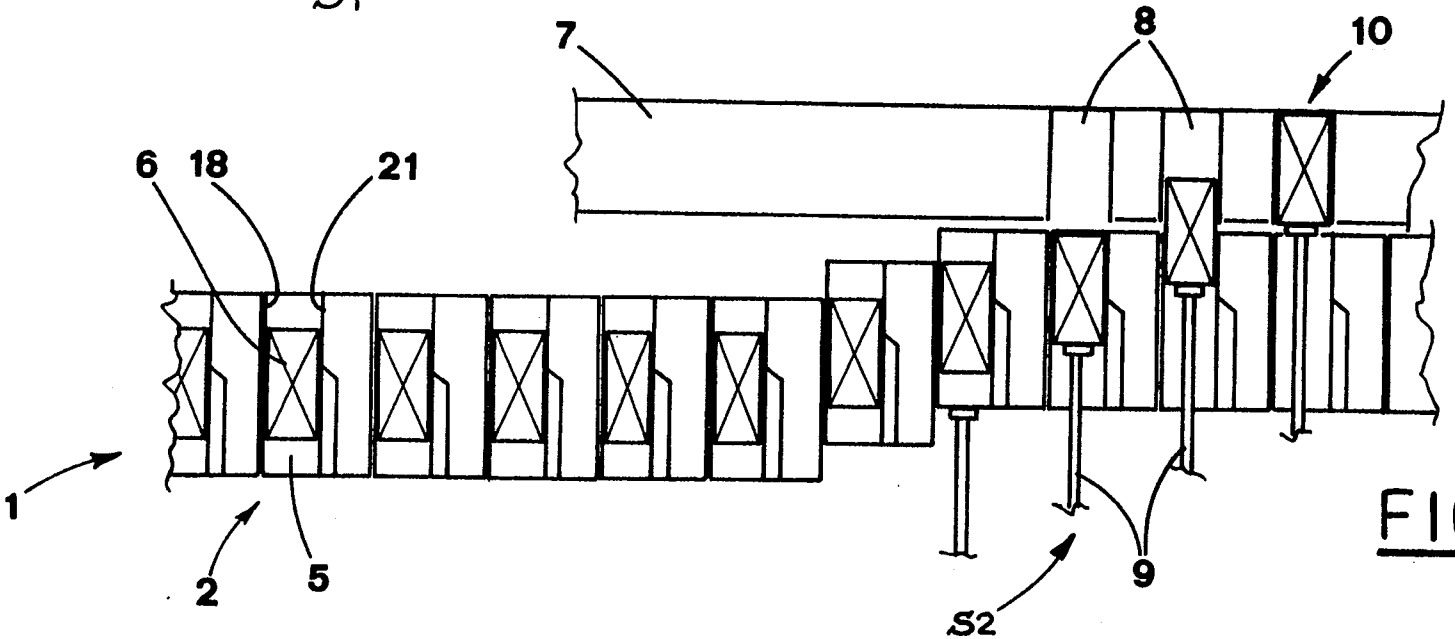
FIG. 2 is a plan view of the drawer conveyor during operation.

With reference to FIG. 2, numeral 1 indicates a drawer conveyor, each drawer 2 of which consists of a first stationary element. 18 and a second element 21.

The elements 18 and 21 are placed longitudinally to the conveying direction and they define a housing 5 designed to receive the product 6 loaded by known loading means, not illustrated.

The products 6, hold in that manner, are conveyed along the packaging line up to the station S2 in which the drawers 2 of said conveyor 1 come up by the side of another conveyor 7.

Generally, the conveyor 7 has holding elements for placing thereon preformed erected cases 8, and for conveying them along the packaging line with at least one open side facing the conveyor 1.

At a station S2, the products 6 while being advanced are also translated inside the cases 8 by generic pushing means indicated with 9, to obtain packages 10.

Figure 3:
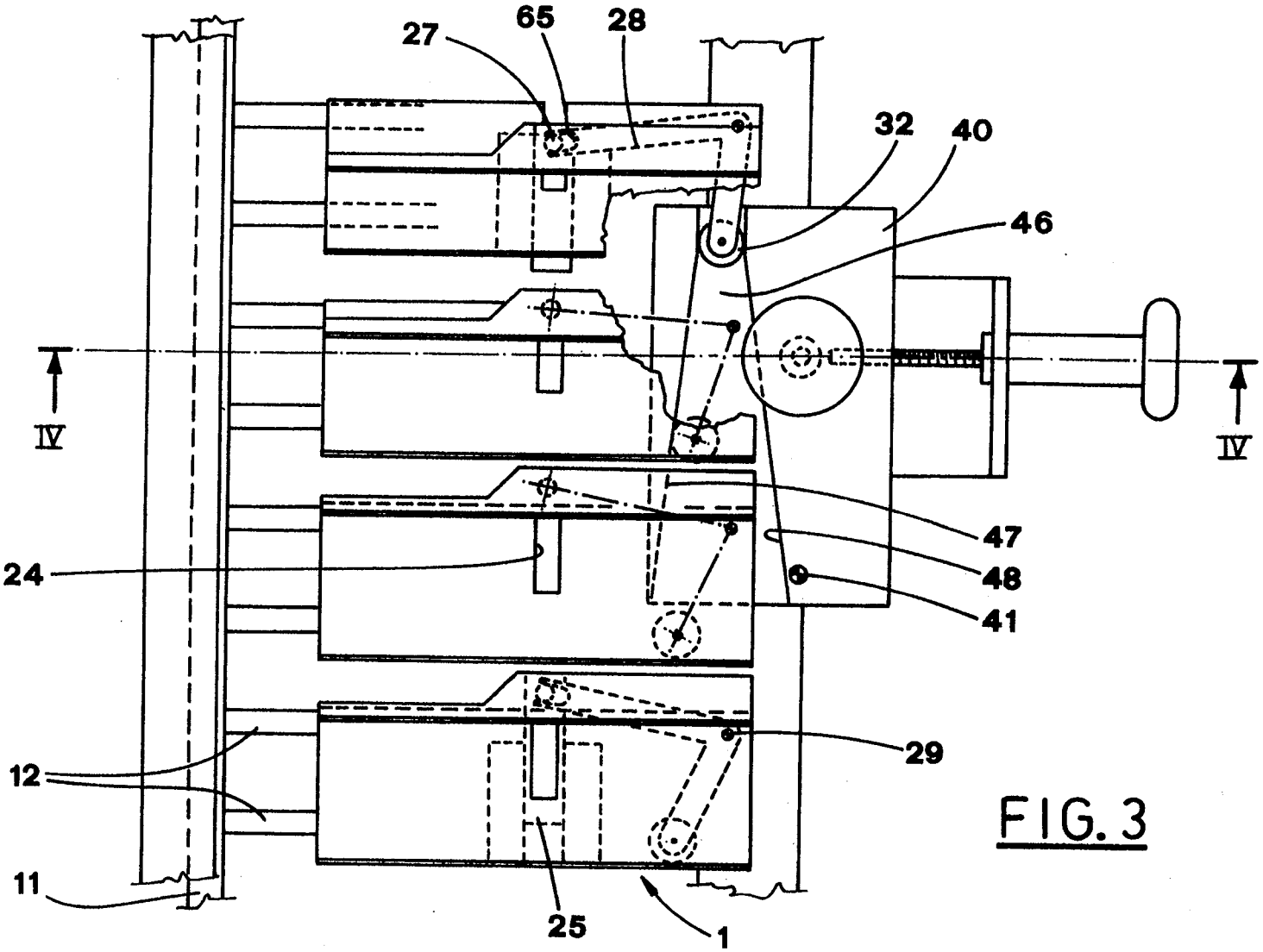
FIG. 3 is a plan view of an adjusment station.
Figure 4A:
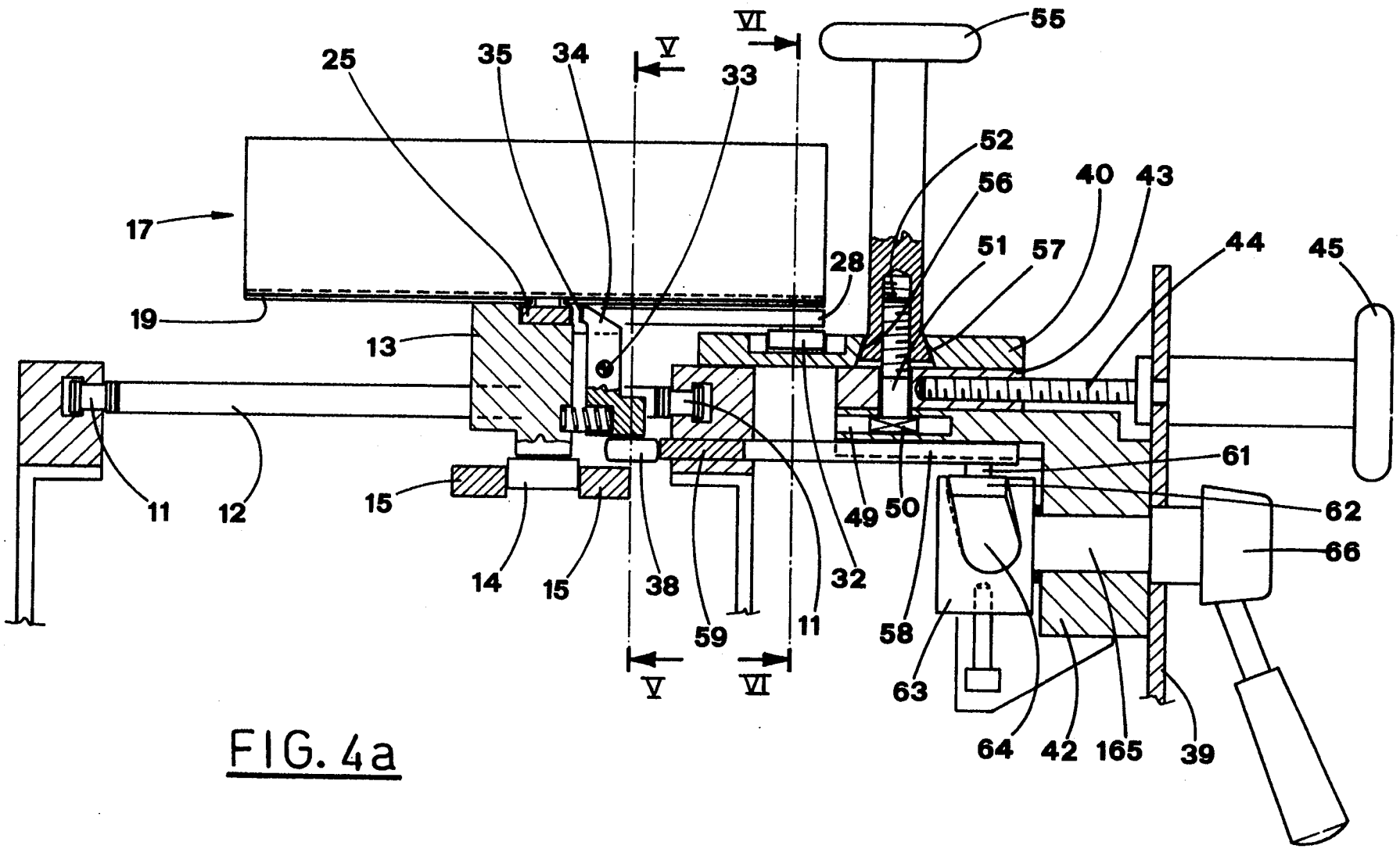
FIG. 4*a* is a section view along the IV—IV line of the FIG. 3 with the conveyor in operation.
Figure 5:
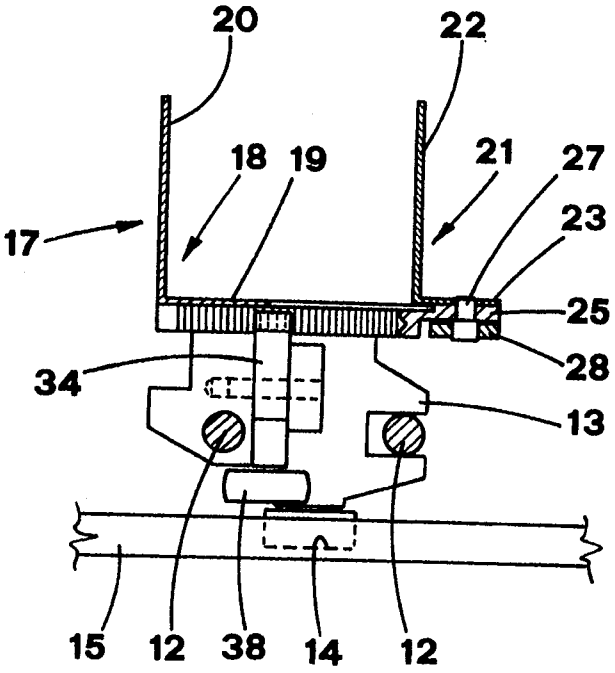
FIG. 5 is a section view along the V—V line of FIG. 4*a;*

With reference to the FIGS. 3, 4*a* and 5, the drawer conveyor 1 includes a pair of chains 11 parallel to the packaging line and carrying cross bars 12 that engage and support slidingly a convey block 13 so as to advance it along the packaging line.

At its lower end, the convey block 13, carries a pivoted idle cam following roller 14 designed to engage with a cam 15.

The cam 15 locates the convey block 13 by moving it transversally, and at the station S2 the cam brings the convey block to come alongside the packages conveyor 7 so that the the drawers 2 are partially inserted into the respective cases 8, through the open side of the latters.

Near to its top, said convey block 13, carries a drawer support body 17 that comprises the first "L"-like element 18, bound to said convey block 13, and the second "L"-like element 21, slidingly guided in direction normal to the first element 18.

The first element 18 includes a bottom wall 19 of the drawer body 17, that is fixed to the convey block 13, and a first stationary wall 20.

The second element 21 includes a second wall 22 and a plan 23 that is slidingly resting on the upper surface of the bottom wall 19 of the drawer body 17.

With reference to FIGS. 8*a* and 8*b*, showing the guide means which connect the elements 18 to the element 21, the plan element 23, joint to the second wall 22, has its bottom fixed to a sliding guide element 25, shaped like an upturned "T". The element 25 slides freely in a slot 24 made in the bottom wall 19 (see FIG. 3).

The element 25 is a rack element that adheres and slides very near to the lower plane of the bottom wall 19, and extends transversally to the walls 20 and 22 until it fits into an opening 26 made in the convey block 13 (see FIG. 8*b*).

The plane 23 and the rack sliding element 25 are fixed one to another and they carry a pivot 27 that pass through a slot 65 made at the end of an angular lever 28 pivoted in 29 on the bottom wall 19 of the drawer body 17.

The other end of the lever 28 carries a roller 32 that, when it is shifted, causes the second wall 22 to move while remaining parallel to the stationary wall 20 of the drawer body 17.

In this way, translation means for the second wall are defined.

Figure 4B:
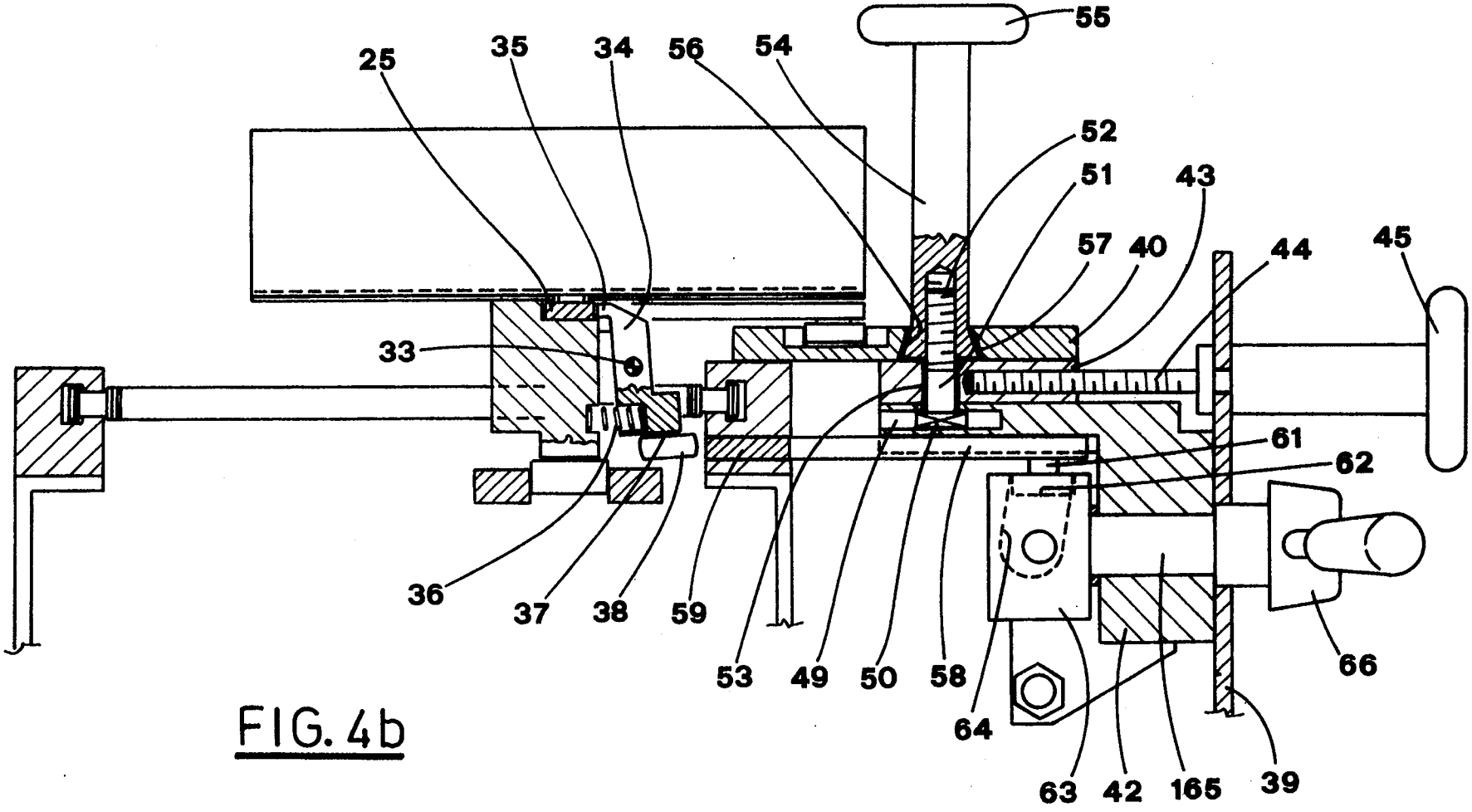
FIG. 4*b* is a section view along the IV—IV line of the Figure while the conveyor is in the adjustment phase.
Figure 6:
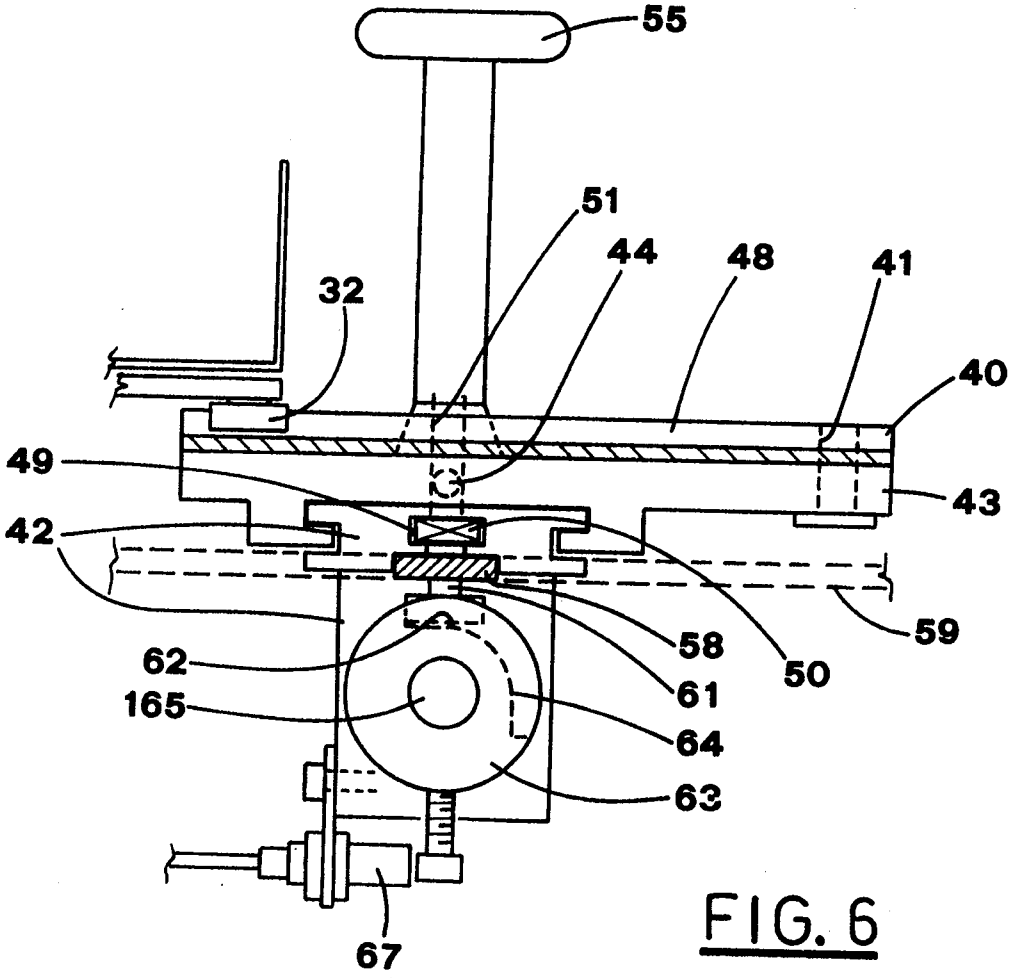
FIG. 6 is a section view along the VI—VI line of the FIG. 4*a;*

With reference to FIGS. 4*a* and 4*b*, the convey block 13 carries locking means which include a rocker lever 34 pivoted in 33, the upper end of which carries a toothed sector 35 designed to be positioned in engagement with or disengagement from the teeth of the rack 25.

When the toothed sector 35 is pushed on the rack 25, the second wall 22 is locked to the drawer body 17 and to the convey block 13.

The lower part of the lever 34 carries a reset spring 36 and a pivot 37 carrying a roller 38.

When the roller is shifted, in the way that is better explained in the following, the toothed sector 35 is disengaged from the rack 25, and the wall 22 is released from the drawer body 17 and to the convey block 13.

Still with reference to the FIGS. 3, 4*a*, 4*b* and 6, the conveyor structure 39 has fixed thereto a support block 42 that in its upper part carries a shifting plate 43.

The plate 43 slides transversally to the conveying direction by means of prismatic coupling guides (See in particular FIG. 6) and positioning means.

In fact, its end opposite to the conveyor 1, the positioning plate 43, is in screwed engagement with a threaded bar 44 that is keyed on a handwheel 45 rotatably mounted turningly on the conveyor structure 39.

In that manner, a coupling is obtained in which, by the rotations of the handwheel 45, the plate 43 moves transversally to the conveying direction.

In its upper part, the plate 43, carries a plate 40 pivoted by a pivot 41.

The surface of the plate 40 facing the conveyor 1 has made therein a funnel-like groove 46 which forms shifting means, or cam tracks 47, 48, designed to engage the roller 32 of the angle lever 28.

Linking means between the positioning means and the shifting means are now described.

Inside the support block 42, there is made a notch 49, in which the head 50 of a bolt 51 is inserted slidingly so that it cannot rotate.

The bolt shaft 52 extends upwards passing through the walls 53 of a cylindrical hole made in the plate 43, until it screws into the shaft 54 of a clamping 55 handwheel.

The free end of the shaft 54 of said clamping handwheel 55 is in form of a cone 56 and enganges reciprocally with a conical hole 57 made in the plate 40 in such a way that, acting on the handwheel 55, it is possible to obtain a coupling, between the plates 40 and 43, with (see FIG. 4*b*) or without clearance (see FIG. 4*a*).

Thanks to the pivot between the plates 40 and 43, to the pivot 41, and to the conical coupling of the cone 56 with the conical hole 57, said plate 40 can oscillate, as indicated in FIG. 4*b*, adapting conical coupling with clearance or a non-oscillating coupling, as indicated in FIG. 4*a*, adopting a conical clamped coupling.

In its lower part, the support block 42 carries a sliding prismatic bar 58, placed transversally to the conveying direction.

The free end of said bar 58, placed at the side of the conveyor, carries a plate 59 with a cam profile 60 designed to cooperate with the roller 38 of the locking means.

The other end of said bar 58 carries a pivot 61, on which a roller 62 is rotatably mounted, said roller 62 being engaged in a path 64 of a drum cam 63, mounted on a shaft 165 rotatably supported by the same support block 42 and keyed on a lever hub 66 for its rotation.

Acting on the rotation of the lever 66, the plate 59 procedes or withdraws transversally to the conveying direction, entering in striking trajectory with the roller 38 or leaving the striking trajectory.

In the above described drawer conveyor, the automatic adjustment requires an adjustment station S1 placed along a section of the conveyor path and that can be enabled or disabled.

One way of carrying out the adjustment operation is now described as a mere example, not limitative.

Figure 7:
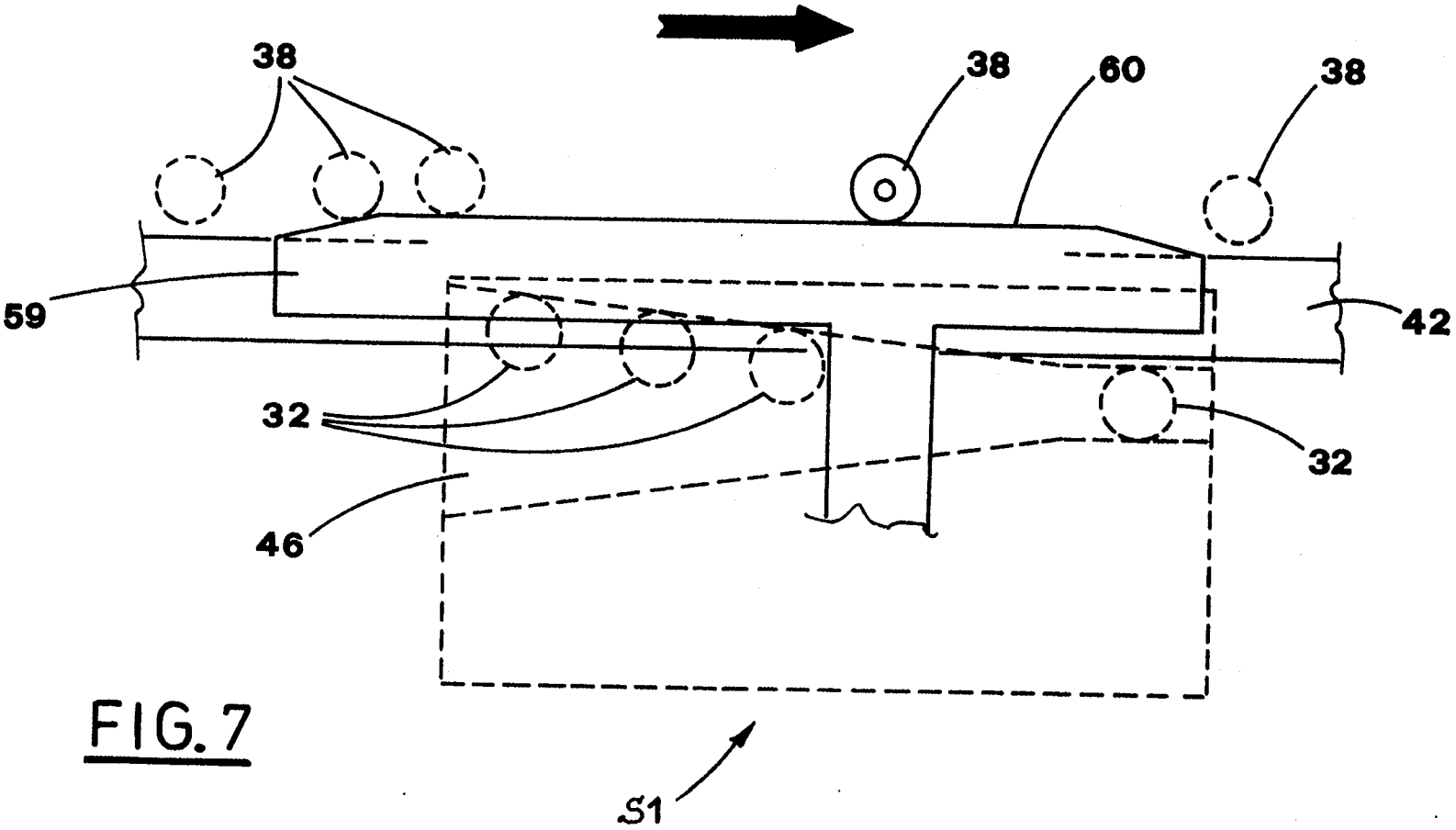
FIG. 7 is a schematic plan view of the adjustment station in the operative phase.

When the drawer conveyor is standstill or in movement, the plate 59 is moved forward, in the drawer conveyor 1 direction, by turning the shaft 165 by means of the lever 66, in such a manner that the cam-shaped profile 60 of the plate 58 be located along a path directed to strike the rollers 38 of the locking means associated to the related support blocks 13, thus defining three operating sections for the said rollers 38 (see FIG. 7).

With this configuration the conveyor 1 goes on through one complete turn, so that all drawers pass through the cited station 1 and undergoes therein the following actions:

the roller 38 strikes the first raising section of the cam profile 60, so that the rocker 34 swings from a first position, that causes the wall 22 to be locked to the stationary wall 20, to a second position wherein the wall 22 is released and free to move with respect to the stationary wall 20;

the second section of the cam profile 60 keeps on acting on the roller 38, so that the wall 22 remains in a released condition, while the roller 32 engages the funnel-like groove 46 so that the wall 22 is set at a pre-determined distance from the stationary wall 20 by means of the lever translating means 28;

lastly, the third section of the cam profile 60 progressively releases the rocker 34 that, because of the action of the spring 36, swings back to the original position, wherein the wall 22 results to be locked, and is thus well adjusted for the new article size.

When the turn of the conveyor has been completed all the drawers have passed through the adjustment station S1 and consequently all of them have been adjusted to suit the new article size.

At this point, by acting on the tightening wheel 55 the conical coupling 56–57 is disconnected, due to the clearance that results in the coupling, while by acting on the lever arm 66, the plate 59 is moved back, until it reaches its idle position (see FIG. 4*b*).

During operation of the conveyor, the rollers 38 do not strike the cam profile 60, since this last profile is in a retracted position. The plate 40 is free to swing about the pivot 41 and along an arch that is defined by the clearance set in the conical coupling 56–57, so that possible oscillations of the rollers 32 running in the grooves 46 and which are not perfectly lined up, have no effects.

Furthermore, in order to avoid accidents, there is a sensor 67 located near to the lever arm 66, designed to detect the operating or idle condition of the plate 59.

The most characterizing feature of the present invention is that the second wall 22 is made movable with respect to the stationary wall 20, that the wall 22 is kept in such mobile condition for a pre-set section of the conveyor 1 path, so as to allow the distance between the movable wall 22 and the stationary wall to be adjusted to suit a certain size of the articles, and finally to lock again the wall 22 with respect to the convey block 13.

As an alternative to the above, the adjustment can be carried out by means of spacing plugs which are manually set into operation by an operator. The spacing plugs can be also somehow associated to the conveyor 1, for example by mounting them on a disc, or a drum, that is coaxially keyed to one of the wheel on which the chains of the conveyor 1 run.

These spacing plugs should be placed between the walls 22 and 20 of the drawers, when the walls are located at the maximum distance from one another, the beginning of the adjustment operation, and when the movable wall is moved nearer to the stationary wall 20, it is stopped by the plug, so that a pre-determined distance between the two walls 20 and 22 is set and subsequentely stabilized by the locking of the movable wall 22.

Advantageously, the movable wall is moved against the elastic reaction of spring means, which allow to eliminate the effects of unavoidable clearances that exists among the means designed to move the movable wall. Thus dangerous mechanical stresses acting on the same moving means, due to anomalous situations which can occur while adjusting the size of the drawer, are avoided.

As an alternative to the rack member 25 and to the connected toothed sector 35, any other mechanical means able to allow blocking of the movable wall 22 to the convey block 13, can be used. For example a high member and the toothed sector.

It must be stressed that [that] has been said above concerns every drawer so that a possible anomalous situation affecting the means designed to drive the drawer conveyor and/or the means designed to carry out the adjustment, do not have similar effects on all the drawers.

It must be also highlighted that all that has been proposed can be applied to a drawer conveyor including a pair of chains, with all the advantages that this brings about with respect to the prior art described in the introductory statement.

What is claimed is:

1. A conveyor automatically adjusted in accordance with the size of articles to be transported, said conveyor running along a closed loop path and being equipped with transporting drawers, each drawer comprising a pair of walls, said conveyor including:

conveying means comprising a first stationary wall and a second wall, the second wall being adapted to take one or another of two different configurations, a first configuration in which the second wall is locked, and a second configuration in which the second wall is released and movable with respect to the first stationary wall;

operating means for releasing the second wall of a drawer while the drawer is moving through a first section of the closed loop path, to let the second wall move freely while the drawer is moving through a second section of the closed loop path, and for then locking the wall previously released when the drawer reaches a third section of the closed loop path;

positioning means for locating the second wall at a pre-set distance from the first stationary wall as it moves through the second section of the closed loop path;

guiding means for slidingly guiding said second wall while moving nearer to or farther from said first stationary wall;

translating means designed to impose a translation to said second wall; and, locking means for locking the second wall with respect to the first stationary wall.

2. The conveyor according to claim 1 wherein said guiding means include a pair of prismatic couplings positioned in a central location with respect to a drawer and along a longitudinal direction of the same drawer, and having a sliding member positioned beneath the bottom of the drawer in a groove made in the conveying means, said sliding member having an end fixed to said second wall, to define a double "T" slidable along a slot made in a bottom of said drawer, transversely with respect to the first and second walls.

3. The conveyor according to claim 1 wherein said locking means include:

a first rack element fixed to said second wall and slidingly guided by the conveying means;

a second lever element pivoted to the conveying means and swingable perpendicularly to the first rack element, an end of the second lever element having a toothed sector adapted for engagement and disengagement from the first rack member, the second lever element at its other end having a cam-follower roller designed to cooperate with the operating means for causing the second lever element to swing; and, a reset spring acting on said second lever element, said spring being designed to reset the second lever element to the position where it is in engagement with the first rack element.

4. The conveyor according to claim 1 wherein said translating means include an angle lever arm positioned beneath a bottom of the drawer and pivoted thereto, said angle lever arm having an end hinged to said second wall, said angle lever arm at its other end having a cam-follower roller designed to cooperate with said guiding means.

5. A conveyor automatically adjusted in accordance with the size of the articles to be transported, said conveyer running along a closed loop path and being equipped with transporting drawers, each drawer comprising a pair of walls, said conveyor including:

conveying means comprising a first stationary wall and a second wall, the second wall being adapted to take one or another of two different configuration, a first configuration in which the second wall is locked, and a second configuration in which the second wall is released and movable with respect to the first stationary wall;

operating means for releasing the second wall of a drawer while this drawer is moving through a first section of the closed loop path, to let the second wall move freely while the drawer is moving through a second section of the closed loop path, and for then locking the wall previously released when the drawer reaches a third section of the closed loop path;

positioning means for locating the second wall at a preset distance from the first stationary wall;

said operating means having a plate movable along a direction that is transverse to the conveyor direction, an edge of said plate facing said conveying means and being profiled to form a cam extending longitudinally to the conveying direction, such that said edge cooperates with said conveying means, said plate having a cam-follower roller positioned near an edge of said plate opposite to the cam profiled edge, the roller designed for running inside a cam groove made on a drum rotatably supported by a conveyor structure, the roller causing the sliding of said plate transversely with respect to the conveying direction to shift the second wall accordingly.

6. A conveyor automatically adjusted in accordance with the size of articles to be transported, said conveyor running along a closed loop path and being equipped with transporting drawers, each drawer comprising a pair of walls, said conveyor including:

conveying means comprising a first stationary wall and a second wall, the second wall being adapted to take one or another of two different configurations, a first configuration in which the second wall is locked, and a second configuration in which the second wall is released and movable with respect to the first stationary wall;

operating means for releasing the second wall of a drawer while the drawer is moving through a first section of the closed loop path, to let the second wall move freely while the drawer is moving through a second section of the closed loop path, and for then locking the wall previously released when the wall reaches a third section of the closed loop path;

positioning means for locating the second wall at a preset distance from the first stationary wall, said positioning means including shifting means for shifting the second wall disposed in accordance with a longitudinal direction, the shifting means being movable along a direction transverse to a conveying direction;

adjusting means for moving said shifting means and for defining a transverse position for the shifting means; and link means for connecting said shifting means to said adjusting means.

7. The conveyor according to claim 6 wherein said shifting means include a first shifting plate having a funnel-like groove located parallel to the conveying direction for engaging the positioning means.

8. The conveyor according to claim 6 wherein said adjusting means include an adjusting wheel rotatably mounted on a conveyor structure and supporting a threaded bar keyed thereto, said adjusting wheel being perpendicular to the conveying means, the threaded bar being in screw engagement with a shifting plate.

9. The conveyor according to claim 6 wherein said link means include a conical adjustable coupling comprising a conical member connected to said shifting means and another conical member connected to said adjusting means.

10. A conveyor automatically adjusted in accordance with the size of the articles to be transported, said conveyor running along a closed loop path and being equipped with transporting drawers, each drawer comprising a pair of walls, said conveyor including:

conveying means comprising a first stationary wall and a second wall, the second wall being adapted to take one or another of two different configurations, a first configuration which the second wall is locked and a second configuration in which the second wall is released and movable with the respect to the first stationary wall;

operating means for releasing the second wall of a drawer while the drawer is moving through a first section of the closed loop path, to let the second wall move freely while the drawer is moving through a second section of the closed loop path and for then locking the wall previously released when the drawer reaches a third section of the closed loop path;

positioning means for locating the second wall at a preset distance from the first stationary wall; and first sensor means cooperating with said operating means to detect the operation or non-operation of the operating means.

11. A conveyor automatically adjusted in accordance with the size of the articles to be transported, said conveyor running along a closed loop path and being equipped with transporting drawers, each drawer comprising a pair of walls, said conveyor including:

conveying means comprising a first stationary wall and a second wall, the second wall being adapted to take one or another of two different configurations, a first configuration in which the second wall is locked and a second configuration in which the second wall is released and movable with the respect to the first stationary wall;

operating means for releasing the second wall of a drawer while the drawer is moving through a first section of the closed loop path, to let the second wall move freely while the drawer is moving through a second section of the closed loop path and for then locking the wall previously released when the drawer reaches a third section of the closed loop path;

positioning means for locating the second wall at a preset distance from the first stationary wall; and spring means for acting on said operating means associated with the movable wall.

* * * * *